US009527713B2

(12) United States Patent
Freeman et al.

(10) Patent No.: US 9,527,713 B2
(45) Date of Patent: Dec. 27, 2016

(54) LOW POWER CONTROL SYSTEM FOR AN ELEVATED WORK PLATFORM

(71) Applicant: Altec Industries, Inc., Birmingham, AL (US)

(72) Inventors: Michael Jon Freeman, Northville, MI (US); Joshua Daniel Mueller, Saint Joseph, MO (US); Allen Leon Maag, Saint Joseph, MO (US); David Lavern Ross, Savannah, MO (US); Mark D. Greer, Kansas City, MO (US)

(73) Assignee: Altec Industries, Inc., Birmingham, AL (US)

( * ) Notice: Subject to any disclaimer, the term of this patent is extended or adjusted under 35 U.S.C. 154(b) by 136 days.

(21) Appl. No.: 13/840,946

(22) Filed: Mar. 15, 2013

(65) Prior Publication Data

US 2013/0313042 A1 Nov. 28, 2013

Related U.S. Application Data

(60) Provisional application No. 61/650,587, filed on May 23, 2012.

(51) Int. Cl.
*B66F 11/04* (2006.01)

(52) U.S. Cl.
CPC ..... *B66F 11/044* (2013.01)

(58) Field of Classification Search
CPC ..... B66F 11/04; B66F 11/044; B66F 11/042; B66F 11/046; B66F 11/048; B66F 17/006; B25J 5/06; H02G 1/02; B60K 7/0015
See application file for complete search history.

(56) References Cited

U.S. PATENT DOCUMENTS 4,456,093 A * 6/1984 Finley et al. ..... 182/2.2
5,107,954 A * 4/1992 Fujimoto ..... 182/2.11
5,268,591 A * 12/1993 Fujimoto ..... H02G 1/02 182/2.11
5,390,104 A * 2/1995 Fulton ..... 700/65
5,731,806 A * 3/1998 Harrow et al. ..... 345/161
5,740,887 A * 4/1998 Unger et al. ..... 187/231
5,944,138 A * 8/1999 Vollmer ..... B66F 11/044 182/2.1

(Continued)

*Primary Examiner* — Katherine Mitchell
*Assistant Examiner* — Shiref Mekhaeil
(74) *Attorney, Agent, or Firm* — Erise IP, P.A.

(57) ABSTRACT

A control system optimized for low-power operation includes an electronic valve controller for controlling a hydraulic valve and a control interface for receiving operating commands from a user and communicating the operating commands to the electronic valve controller. The control interface includes a multi-function single hand control with a plurality of position indicating elements for detecting actuation of the single hand control, a master enable associated with all of the position indicating elements, and a plurality of individual enable elements each associated with one of the position indicating elements. A controller directs operation of the control interface and is configured to sample a position indicating element only if the master enable is asserted and the corresponding individual enable element is asserted. Other aspects of the control system minimize power consumption, including fast sampling that allows the controller to spend more time in a low power mode.

20 Claims, 5 Drawing Sheets

(56) References Cited

U.S. PATENT DOCUMENTS

| | | | | |
|---|---|---|---|---|
| 6,272,413 | B1 * | 8/2001 | Takahashi | B66F 17/006 182/115 |
| 6,325,749 | B1 * | 12/2001 | Inokuchi | B25J 5/06 182/2.11 |
| 6,543,578 | B1 * | 4/2003 | Merz | B66C 13/56 182/148 |
| 6,580,418 | B1 * | 6/2003 | Grome et al. | 345/161 |
| 6,834,436 | B2 * | 12/2004 | Townsend et al. | 33/512 |
| 7,946,386 | B2 * | 5/2011 | Chard | B66F 17/006 182/2.4 |
| 2006/0103500 | A1 * | 5/2006 | Kessler et al. | 338/195 |
| 2009/0236182 | A1 * | 9/2009 | Yamagami | B66F 9/24 187/222 |
| 2010/0302017 | A1 * | 12/2010 | Guglielmo | G05G 9/047 340/407.2 |
| 2013/0319792 | A1 * | 12/2013 | Christian et al. | 182/2.2 |

* cited by examiner

LOW POWER CONTROL SYSTEM FOR AN ELEVATED WORK PLATFORM

RELATED APPLICATION

This non-provisional patent application claims priority benefit, with regard to all common subject matter, of earlier-filed U.S. Provisional Patent Application No. 61/650,587, filed May 23, 2012, and entitled "LOW POWER FIBER OPTIC CONTROL SYSTEM." The identified earlier-filed provisional patent application is hereby incorporated by reference in its entirety into the present application.

FIELD

Embodiments of the present invention relate to control systems for equipment with remotely located control stations, such as elevated work platforms, including aerial devices having a boom and a platform mounted at or near a distal end of the boom (i.e., at the boom tip). More particularly, embodiments of the present invention for use with aerial devices provide a control system for operation of the aerial device, including movement of the boom, by an operator at the platform.

BACKGROUND

Equipment employing remotely located control stations is common. In the electrical and telecommunications industries, for example, elevated work platforms, such as aerial devices, are commonly used to position personnel for work on utility lines, utility poles, transformers, and other elevated equipment. Such devices are also used for a range of other applications such as tree trimming and spotlight maintenance. These devices typically include a telescoping and/or articulating boom mounted on a truck bed or otherwise supported by a vehicle chassis. A personnel-carrying platform, also referred to as a bucket or basket, is attached to a portion of the boom distal the vehicle chassis (i.e., the boom tip). These platforms may be capable of carrying one or more people, and the boom may include supplemental tools or devices proximate the platform for lifting loads or performing other functions.

These devices include control systems with control interfaces located at the platform to enable operators positioned in the platform to control operation of the boom and other devices. Using a control interface located at the platform, for example, an operator may adjust the rotation, extension and articulation of the boom to best position the platform for access to a work site. Aerial devices used in areas that include aerial power lines include a boom and/or platform with a high electrical resistance.

SUMMARY

Embodiments of the present invention provide improved systems and methods for controlling elevated work platforms, such as an aerial device. More particularly, embodiments of the invention provide a control system that electrically isolates a control interface and includes power-saving features and functions to preserve battery life in the control interface. Such power-saving features may include use of a sleep mode that reduces circuit activity when an operator is not using the control interface; reducing the time required for control input sampling to maximize use of the sleep mode; control input sampling enables that limit sampling operations to only those functions in active use by an operator; detection of faulty circuit elements to avoid sampling faulty circuits; and minimizing the power requirements of communication signals through bit inversion. Additional features and functions of the present invention may be used to minimize power consumption, reduce the risk of malfunction, and enhance operability, as discussed herein.

A system constructed in accordance with an embodiment of the present invention comprises an electronic valve controller for controlling a hydraulic valve and a control interface for receiving operating commands from a user and communicating the operating commands to the electronic valve controller. The control interface includes a multi-function single hand control with a plurality of position indicating elements for detecting actuation of the single hand control, a master enable switch (hereinafter referred to as a "master enable") associated (e.g., communicatively coupled) with all of the position indicating elements, and a plurality of individual enable elements each associated (e.g., communicatively coupled) with one of the position indicating elements. A controller controls operation of the control interface and is configured to sample a position indicating element only if the master enable is asserted and the corresponding individual enable element is asserted.

In another embodiment of the invention, the control interface communicates the operating commands to the electronic valve controller through a fiber optic communications link. The control interface includes a multi-function single hand control with a plurality of potentiometer circuits for detecting actuation of the single hand control, a capacitor for energizing the potentiometer during sampling operations, and a high impedance circuit for charging the capacitor. Each of the potentiometer circuits includes a low impedance potentiometer. A master enable associated with all of the potentiometer circuits is physically actuated by an operator. A plurality of individual enable elements are each associated with one of the potentiometer circuits and are physically actuated by movement of the single hand control. A controller controls operation of the control interface and is configured to sample a potentiometer circuit only if the master enable is asserted and the corresponding individual enable element is asserted.

An aerial device constructed in accordance with another embodiment of the invention comprises a boom supported by a vehicle chassis, a platform supported by a portion of the boom distal the chassis, a hydraulic control valve proximate the chassis and/or the boom for controlling operation of the boom, and an electronic valve controller for controlling a solenoid-actuated hydraulic valve. A control interface is located at the platform for receiving operating commands from a user and communicating the operating commands to the electronic valve controller. The control interface includes a multi-function single hand control with a plurality of position indicating elements for detecting actuation of the single hand control, a master enable associated with all of the position indicating elements, and a plurality of individual enable elements each associated with one of the position indicating elements. A controller controls operation of the control interface and is configured to sample a position indicating element only if the master enable is asserted and the corresponding individual enable element is asserted.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
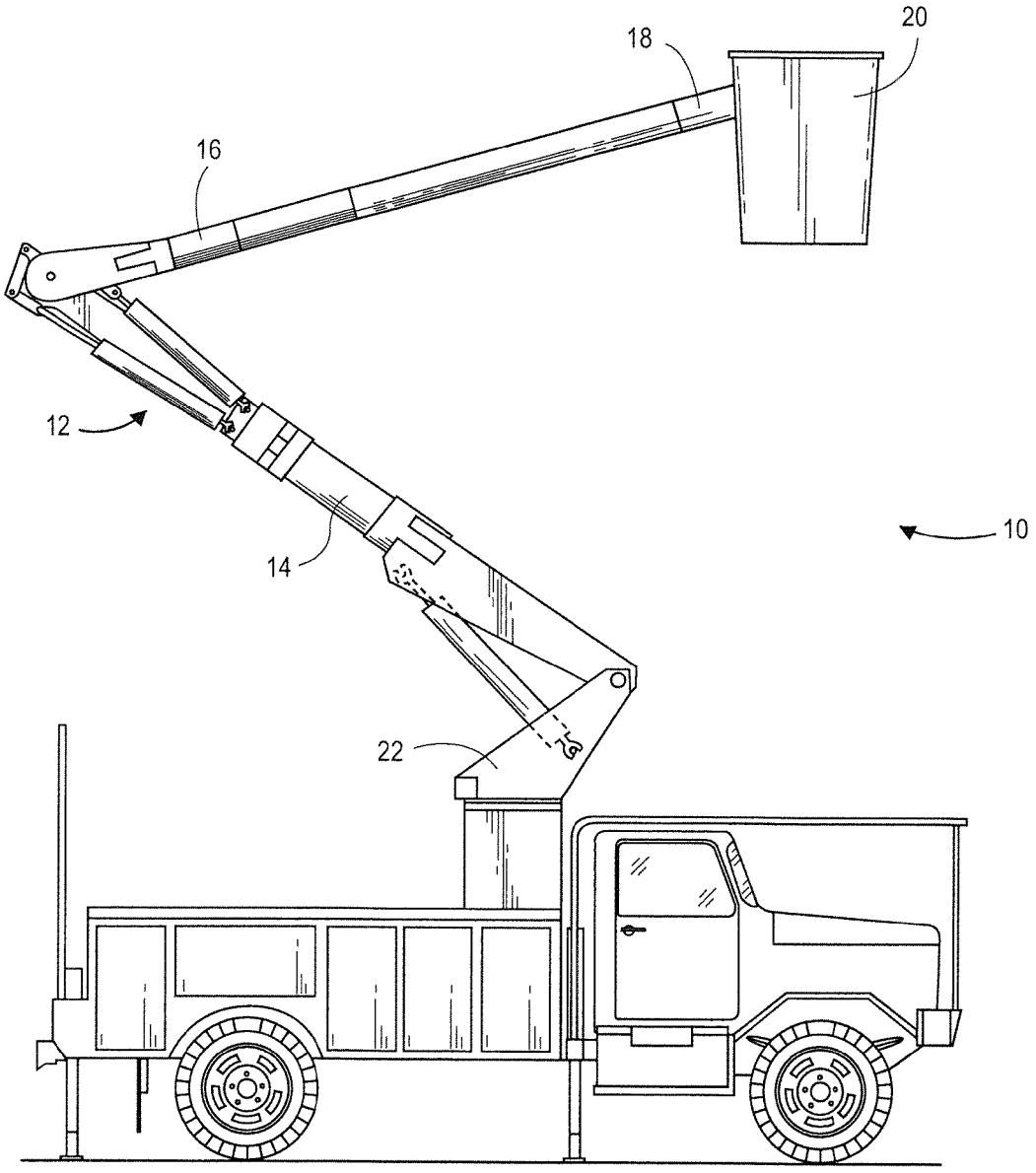
FIG. 1 is a side elevation view of a vehicle with an aerial device constructed in accordance with embodiments of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Embodiments of the present invention comprise a control system, including an electrically isolated control system, for use with equipment having remotely located control stations. Embodiments of the invention will be described with respect to an aerial device 10 illustrated in FIG. 1 having a remotely located control station. However, it will be appreciated that the control system of embodiments of the present invention may be used with other types of equipment, including elevated work platforms, employing remotely located control stations, such as cable placers, digger derricks, pressure diggers, cranes and other equipment.

The aerial device 10 comprises a boom 12 with one or more articulating sections 14, 16, one or more telescoping sections 18, or a combination thereof. A platform 20 configured to hold one or more operators is positioned at a distal end of the boom 12 (i.e., at the boom tip) and is rotatable relative to the boom 12. A proximal end or base of the boom 12 is coupled to a turntable 22 supported by a truck chassis.

Figure 2:
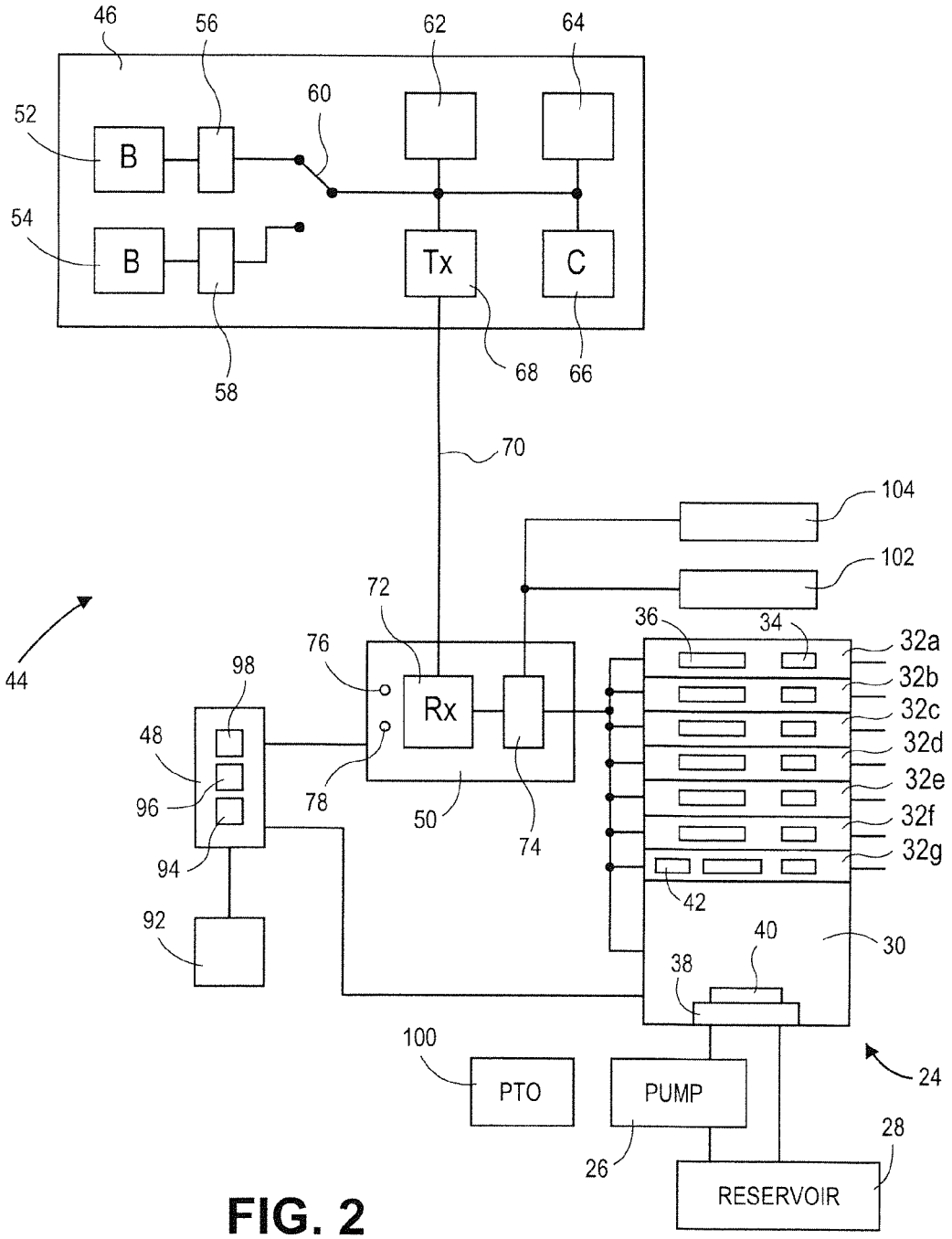
FIG. 2 is a block diagram of a control system in accordance with embodiments of the invention and configured for use with the aerial device.

Referring also to FIG. 2, a hydraulic system 24 is employed to control operation of the aerial device 10 and may be accessed via controls located at or near the platform 20 or via controls located on the truck chassis, such as proximate the turntable 22. The hydraulic system 24 may be an open-center hydraulic system and broadly includes a hydraulic pump 26, a hydraulic fluid reservoir 28 and a proportional control valve 30. The proportional control valve 30 includes a plurality of work sections 32 each associated with a different device or function. By way of example, the different work sections 32 may control lower boom 16 articulation, upper boom 18 extension, turntable 22 rotation, articulating arm 14 articulation, platform 20 leveling, platform 20 rotation, and hydraulic attachments or tools (not illustrated). Each one of the work sections 32 may be manually operated by a lever 34 at or proximate the proportional control valve 30 or may be actuated by a solenoid 36 that receives signals from an external source, such as a valve controller system associated with a control interface located at the platform 20, as explained below in greater detail. The proportional control valve 30 includes a spool 38 that directs hydraulic fluid to the reservoir 28 when in a neutral position and directs hydraulic fluid to the work sections 32 when in an operating position. A solenoid 40 drives movement of the spool 38 and must be energized to drive the spool 38 to the operating position so that the default or no-power position of the spool 38 is neutral.

To preserve the safety of operators on the platform 20, the hydraulic system 24 and/or the electrical control system 44 may be configured to prevent simultaneous operation of the hydraulic tools work section 32*g* and other work sections, such as work sections associated with movement of the boom 12. By way of example, the electrical control system 44 may automatically disable or suspend operation of the hydraulic tools work section 32*g* when the operator moves a control element or otherwise submits a command to move the boom 12. Alternatively, a spool 42 associated with the hydraulic tools work section 32*g* may automatically disable all of the remaining work sections 32*a*-32*f* when the hydraulic tools function is engaged to thereby prevent movement of the boom 12 while the hydraulic tools section 32*g* is in operation. If an operator at the platform 20 is operating a hydraulically-powered chainsaw, for example, the hydraulic tools function is engaged to drive the chainsaw and all of the remaining work sections 32*a*-32*f* are disabled by the spool 42 such that the aerial device 10 cannot be moved even if the operator inadvertently actuates a control input that would otherwise induce movement in the aerial device 10.

An electrical control system 44 controls the proportional control valve 30 and broadly comprises an upper control interface 46 located at the platform 20, a lower control interface 48 and an electronic valve controller 50. The upper control interface 46 is located at the platform 20 and is preferably housed in a single console positioned for easy and convenient access by an operator positioned in or at the platform 20. The console housing the upper control interface 46 may be mounted on the platform 20 or the boom 12 using an electrically non-conductive bracket or other mounting mechanism (not shown) that positions the console a sufficient distance from the boom or platform to electrically isolate the interface 46 from any conductive components that may be present in the boom 12 and/or platform 20. The interface 46 may be positioned, for example, six inches or twelve inches from the boom 12 and/or platform 20.

The upper control interface 46 broadly includes a primary battery 52 and a reserve battery 54, one or more battery capacity test circuits 56, 58, a switch 60 for selectively connecting one of the batteries 52, 54 to the other electrical components of the control interface 46, a multi-function single hand controller 62 (also referred to herein as a "single hand control"), a plurality of switches 64 or other user interface elements, a digital controller 66, and a communications transmitter 68. The upper control interface 46 receives control commands from the operator via the single hand controller 62 and/or the switches 64, generates control signals based on the control commands and communicates the control signals to the electronic valve controller 50 via a communications link 70, such as a fiber optic cable or a wireless communications link. A communications receiver 72 at the electronic valve controller 50 receives the control signals and translates the control signals to a format that is compatible with a valve driver 74.

If the electrical control system 44 uses fiber optic communications, the transmitter 68 in the upper control interface 46 translates the control signals from electrical to optical format while the receiver 72 at the electronic valve controller 50 translates the received control signals from optical format back to electrical format for use by the valve driver 74. If the electrical control system 44 uses wireless communications, the transmitter 68 translates the control signals to a wireless format while the receiver 72 translates the received wireless signals to a format compatible with the valve driver 74. Because the upper control interface 46 communicates with the electronic valve controller 50 exclusively via a fiber optic or wireless communications link 70, the upper control interface 46 is electrically isolated from the other components of the electrical system 44 and from the hydraulic system 24.

The upper control interface 46 is energized by a power source that is isolated from all other components and systems external to the upper control interface 46. In the illustrated embodiment, the upper control interface 46 is energized by the batteries 52, 54. A capacity monitoring circuit 56, 58 is associated with each of the batteries 52, 54 and generates battery capacity signals that are communicated to the electronic valve controller 50, which provides a visual indication of the status of each of the batteries 56, 58. If the voltage of either battery drops below a predetermined level, for example, a corresponding status indicator 76, 78 may be illuminated. The batteries 52, 54 may be conventional nine volt batteries.

A status of each of the batteries 52, 54 may be determined by the corresponding battery capacity test circuit 56, 58 and communicated to the controller 66 to be sent to the electronic valve controller 50 via the transmitter 68. The controller 66 may send battery capacity information to the electronic valve controller 50 with each packet of data communicated to the receiver 72, or may send the information less frequently.

The digital controller 66 includes one or more integrated circuits programmed or configured to implement the functions described herein. By way of example, the digital controller 66 may include one or more general purpose microprocessors or microcontrollers, programmable logic devices, or application specific integrated circuits. The digital controller 66 may also include one or more discrete and/or analog circuit components operating in conjunction with the one or more integrated circuits. Furthermore, the digital controller 66 may include or have access to one or more memory elements operable to store executable instructions, data, or both. In some embodiments the digital controller is a microcontroller with built-in memory.

Figure 3:
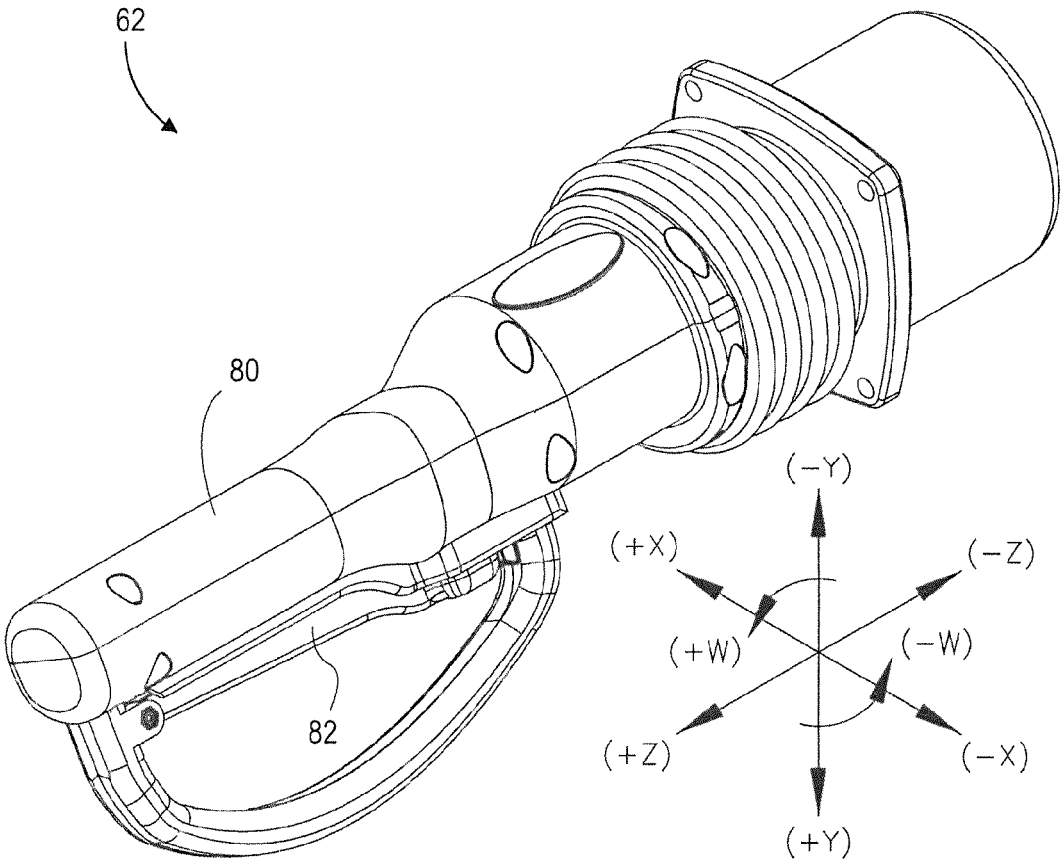
FIG. 3 is a perspective view of a multi-function single hand control associated with a control interface of the control system of FIG. 2.
Figure 4:
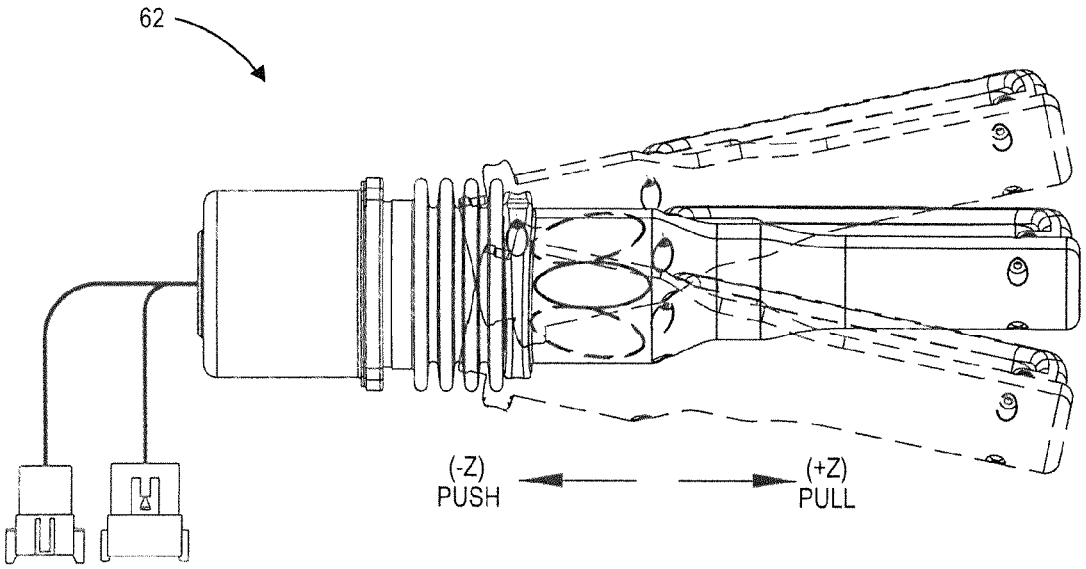
FIG. 4 is a plan view of the hand control of FIG. 3.

The multi-function single hand controller 62 allows an operator to control various functions of the aerial device 10 with a single hand. In some embodiments, the single hand controller 62 is a four-function controller as illustrated in FIGS. 3 and 4 that includes a handle 80 and a trigger 82 adjacent the handle 80. In some implementations the single hand controller 62 is positioned so that it extends horizontally toward the operator. In that position, moving the handle 80 up and down along the Y axis causes the boom 12 to move up and move down; telescoping the handle 80 in and out along the Z axis (i.e., pushing the handle 80 in and pulling it out from the perspective of the operator) causes the telescoping section 18 of the boom to telescope in and out; moving the handle 80 left and right along the X axis controls rotation of the turntable 22; and twisting the handle 80 clockwise and counterclockwise (indicated by the "+W" and the "−W" in FIG. 3) controls the articulating arm 14. The trigger 82 provides a master enable for the functions associated with the single hand controller 62 and connects power to the hand controller circuitry. When the operator desires to use the hand controller 62 to operate one of the functions associated with it, he or she must squeeze the trigger 82 and move the handle 80 in the desired direction. Squeezing the trigger 82 both applies power to the hand controller circuitry and enables the digital controller 66 to sample circuits associated with the various functions, as explained below in greater detail.

Figure 6:
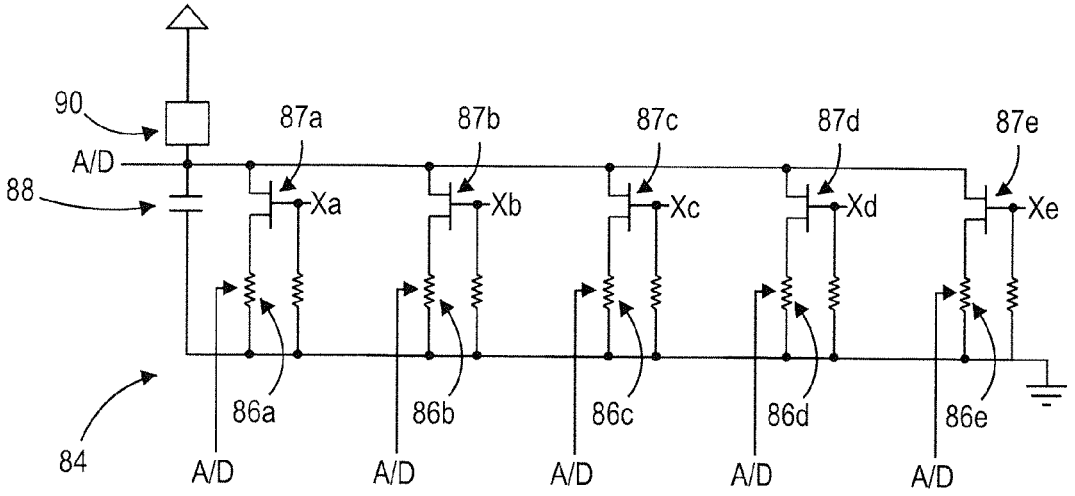
FIG. 6 is a schematic diagram of various potentiometer circuits used as position indicators to detect a position of the hand control of FIG. 3.

The single hand controller circuitry 84 includes five potentiometers 86, a capacitor 88, a high impedance circuit 90 and a plurality of transistors 87 each associated with one of the potentiometers 86, as illustrated in FIG. 6. Each transistor 87 selectively connects the corresponding potentiometer 86 to the capacitor 88 as part of the sampling process. The potentiometers may be housed in the handle 80, for example, while the other circuit components are housed in the transmitter 68. One of the potentiometers 86 may indicate movement along each of the X and Y axes and the twisting motion, while two of the potentiometers 86 may be used to indicate movement along the Z axis. The digital controller 66 periodically samples each of the potentiometers 86 by applying a voltage across the potentiometers 86 and measuring the current induced in the potentiometer by the applied voltage.

The potentiometers 86 preferably present a low impedance to decrease the amount of time required for the current through the potentiometers to stabilize during sampling. The impedance of each of the potentiometers 86 may be, for example between 200Ω and 10 kΩ, and in some embodiments is 1 kΩ. The amount of time required for each sample depends on the impedance of the potentiometers 86 and thus may vary from one embodiment of the invention to another. In some embodiments, the sample time is between about one microsecond and about ten microseconds, and may particularly be about two microseconds, about three microseconds, or about five microseconds.

The capacitor 88 is charged by the high impedance circuit 90 between samples and energizes the potentiometers during sampling. The capacitor 88 and high impedance circuit 90 shield the batteries 52, 54 from current spikes associated with sampling operations. The high impedance circuit 90 may include, for example, a relatively high value resister with an impedance between 1 kΩ and 10 kΩ. More particularly, the high impedance circuit 90 may include a resister with an impedance of about 3.3 kΩ.

The circuitry 84 enables fault detection and, in the event of a fault such as a short circuit, shields the batteries 52, 54 from excessive current draw. The digital controller 66 measures the voltage on the capacitor 88 immediately after sampling any of the potentiometers 86 to determine the total current drawn from the capacitor 88 and to check for faults. The residual charge on the capacitor 88 will be within a predictable range of voltages if the corresponding potentiometer has the correct impedance and is properly connected. A residual voltage above the expected range may indicate a broken wire or a high impedance potentiometer. Similarly, a residual voltage below the expected range may indicate a short circuit. If the controller 66 determines that the residual charge is either above or below the expected range, it may disregard the sample. This fault detection protects against faults that may occur if external components, such as the potentiometers 86, are damaged or connected incorrectly.

The group of switches 64 may be used to control the platform leveling, platform rotation, and hydraulic tools start/stop functions, as well as other functions not associated with the proportional control valve such as secondary stowage and emergency stop controls. As mentioned above, the transmitter 68 receives control signals from the digital controller 66 and communicates the signals to the receiver 72 via the communications link 70. The control signal is sent periodically such that the transmitter 68 is transmitting only a fraction of the time that the upper control interface 46 is in operation. The transmitter 68 may send controls signals, for example, at an interval of between 0.001 and 0.1 seconds. Reducing the amount of transmit time in this manner preserves the life of the batteries 52, 54.

The lower control interface 48 is powered by a chassis electronic control module 92 and includes an upper/lower control selector switch 94, an emergency stop button 96 for the upper and lower controls, and a connector interface 98 for calibration and diagnostics instruments. The upper/lower control selector switch 94 enables either one or the other of the electronic valve controller 50 and the lower controls that include the manual levers 34. If upper control is selected, power from the chassis electronic control module 92 is communicated to the electronic valve controller 50 to enable control of the proportional control valve 30 via the upper control interface 46. If the lower controls are selected, no power is communicated to the electronic valve controller 50, and the solenoid 40 is energized to enable operation of the hydraulic system 24 via the levers 34 located at the proportional control valve 30.

The electronic valve controller 50 and the proportional control valve 30 receive electric power from the truck's electrical power system via the chassis electronic control module 92. The chassis electronic control module may communicate the electrical power through a slip ring of the turntable 22 to the upper/lower control selector switch 94. A terminal strip may be located at the turntable to provide electrical ground for these components, and may be connected to chassis ground through the aforementioned slip ring.

Before enabling either the electronic valve controller 50 or the proportional control valve 30, the chassis electronic control module 92 may verify that the truck's operating parameters for the aerial device 10 are met. This may be performed when the power take-off (PTO) 100 is engaged in the cab and may involve, for example, confirming that the truck's parking brake is set and that the truck has been leveled.

When the electronic valve controller 50 is powered on, the receiver 72 receives control signals from the transmitter 68 and communicates the control signals to the valve driver 74. The valve driver 74 decodes the control signals and generates signals for actuating the solenoids 36 associated with the various sections 32 of the proportional control valve 30. The valve driver 74 also generates control signals for an engine start/stop circuit 102 as well as a secondary stowage circuit 104.

The upper control interface 46, and particularly the digital controller 66, are configured to employ various techniques and methods to minimize power consumption. Some of the power-saving techniques and methods may be implemented by a computer program comprising code segments for directing the digital controller 66 to perform the various steps of the techniques and methods discussed in greater detail below.

As mentioned above, the configuration of the potentiometers 86, capacitor 88 and high impedance circuit 90 allows for fast sampling of the potentiometers 86. Conventional methods of reducing power consumption in systems with potentiometers involve using high impedance potentiometers to limit the amount of current drawn through each potentiometer and, therefore, the total amount of power consumed by the circuit. In contrast, the low impedance potentiometers 86 used in various embodiments of the present invention draw a larger amount of current but are sampled for a shorter amount of time because the voltage across the potentiometers 86 stabilizes more quickly. While the average current consumed by the low impedance potentiometers 86 over time may be roughly equivalent to the average current consumed by high impedance potentiometers in an equivalent circuit, the shorter sampling time of the low impedance potentiometers 86 allows the digital controller 66 to take advantage of other power-saving features, such as the low power mode and the sleep mode discussed below. The digital controller 66 may come out of sleep mode, for example, to sample each of the potentiometers 86 and then immediately return to sleep mode. The sample time of a high impedance potentiometer may be two, three or four times as long as the sample time of the low impedance potentiometers. Additionally, the low impedance potentiometers 86 are less susceptible to electrical interference and, therefore, generate a more reliable signal.

The single hand controller 62 includes individual digital analog enable switches associated with each of the analog functions or, in other words, associated (e.g., communicatively coupled) with each of the potentiometers 86. Each digital analog enable is an individual enable element asserted when the operator actuates the handle 80 to manipulate the function associated with the individual enable element. These enables are digital in that the corresponding switch is either on (if the operator moves the handle 80 to use the corresponding function) or off. The digital controller 66 will not sample the potentiometer 86 associated with a particular function if the corresponding individual enable switch is not asserted.

Figure 5:
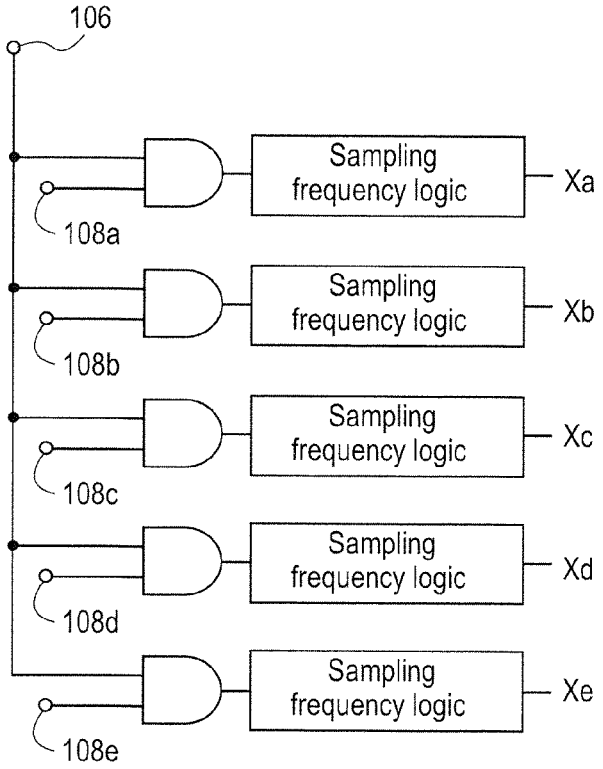
FIG. 5 is schematic diagram illustrating the logical operation of an enable function associated with the hand control of FIG. 3.

As mentioned above, the trigger 82 is a master enable switch for all of the analog functions. Thus, the controller 66 will only sample a potentiometer 86 associated with a particular function if the master enable 106 is asserted (the trigger is squeezed, e.g., actuated) and the individual enable 108 associated with that function is also asserted. FIG. 5 illustrates the logical operation of the master enable 106 and each of the individual enables 108. An AND function is associated with each of the functions/potentiometers such that both the master enable signal and the individual digital analog enable signal must be asserted before the digital controller 66 samples the corresponding potentiometer 86. The output of each AND function drives one of the transistors 87 to enable sampling if further enabled by sampling frequency logic, as illustrated in FIGS. 5 and 6. The sampling frequency logic enables sampling thirty times each second in normal operating mode and ten times each second in low power operating mode. Each sample may last for about two microseconds.

The individual enables 108 provide both power savings and fault protection. Sampling only those functions that are being used (and, hence, are enabled by the individual enables 108) prevents the digital controller 66 from expending energy by sampling inactive functions. Furthermore, the individual enables 108 serve as a safety interlock for each function. If an anomaly such as interference, noise or defective hardware induces a signal on a function, for example, that function is only sampled if the operator actuates the single hand controller 62 to enable it.

The receiver 72 uses a charge pump to ensure that valid signals are received. If a received signal is either logic high or logic low for longer than a period of time determined by the characteristics of the circuit components, the electronic valve controller 50 disables all of the valve drivers of the work sections 32 to prevent any functions from being activated. By thus ensuring that all signals match a predetermined format, corrupted signals will not affect operation of the aerial device. This function may be used, for example, to protect the system from optical signals that are corrupted by or due to ambient light leaking through connectors or faulty hardware. Additionally, this function may be implemented completely in hardware and thus is immune from software errors.

The receiver 72 may implement an automatic gain control function to address fluctuations in the strength of the signal received from the transmitter 68. If the transmitter 68 and the receiver 72 are part of an optical communications system, for example, the strength of the optical signal generated by the transmitter 68 may decrease over time as the strength of the batteries 52, 54 diminishes. As the strength of the received signal decreases, the receiver 72 may automatically increase its gain to compensate for the loss in signal strength.

The controller 66 is configured to use a sleep mode, a low power mode or both to limit power consumption. The sleep mode enables the controller 66 to shut down most of its on-board functions when not used for a predetermined amount of time and to "wake-up" at the end of the predetermined time period or upon receipt of a signal from another component or device. The controller 66 may have a built-in sleep timer, for example, and one or more interrupts operable to wake it up from the sleep mode when asserted.

In addition to the sleep mode, the controller 66 may be configured to operate in the low-power mode wherein the circuitry 84 is sampled less frequently when the controller 66 has not detected activity on the single hand controller 66 for a predetermined period of time. During normal operating mode, for example, the controller 66 may sample the circuitry 84 thirty times each second, while in the low power mode may sample the circuitry 84 four times per second, twice per second or once per second. A low-power mode timer may be programmed via software and may cause the controller 66 to enter low power mode if no activity is detected on the single hand controller 66 for a period of, for example, five seconds, ten seconds, twenty seconds, thirty seconds or one minute.

The controller 66 may also be configured to implement a bit inversion process to reduce the power required to transmit digital control signals from the transmitter 68. Bit inversion is particularly useful in digital fiber optic communication systems where all data is serially encoded and the power required to transmit a packet is directly related to the number of high bits in the packet. Using the bit inversion process, the controller 66 adds an extra "stuff" bit to each byte of data or packet of information sent by the transmitter 68. If more than half of the data bits are high, the controller 66 inverts all of the bits and sets the stuff bit high so that the receiver 72 knows to invert the data back to its original state. The bit inversion process ensures that no more than half of all data bits sent by the transmitter 68 are high.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

The invention claimed is:

1. An elevated work platform comprising:

a boom presenting proximal and distal ends;

a platform located proximate the boom distal end;

a hydraulic control valve generally proximate the boom proximal end;

an electronic valve controller for controlling the hydraulic control valve;

a control interface communicatively coupled with the platform for receiving operating commands from a user and communicating the operating commands to the electronic valve controller, the control interface including— a multi-function single hand control with a set of position indicating elements for detecting actuation of the single hand control, a master enable switch communicatively coupled with the set of position indicating elements, and a set of individual enable elements, wherein each individual enable element in the set of individual enable elements is communicatively coupled with one of the position indicating elements in the set of position indicating elements, wherein the set of individual enable elements includes a first enable element and the set of position indicating elements includes a first position indicating element, wherein the first enable element is communicatively coupled with the first position indicating element; and a controller for controlling operation of the control interface, the controller configured to sample the first position indicating element only if the master enable switch is actuated and the first individual enable element is actuated asserted, said controller being configured to— operate in a normal operating mode, wherein the controller periodically reads the master enable switch and, if the master enable switch is actuated, samples the first position indicating element if the first individual enable element is actuated, if the master enable switch is not actuated for a predetermined amount of time, operate in a low power mode, wherein the controller reads the master enable switch less frequently than in the normal operating mode, and return to the normal operating mode when it samples one of the position indicating elements within the set of position indicating elements.

2. The elevated work platform of claim 1, each of the position indicating elements within the set of position indicating elements including a respective potentiometer.

3. The elevated work platform of claim 2, each of the respective potentiometers having a maximum impedance of between 200Ω and 10 kΩ.

4. The elevated work platform of claim 3, the control interface further including a capacitor configured to energize a first potentiometer of said respective potentiometers when the controller samples said first potentiometer.

5. The elevated work platform of claim 4, the control interface further including a high impedance circuit configured to charge the capacitor, the high impedance circuit having an impedance of at least 500 kΩ.

6. The elevated work platform of claim 4, the controller being configured to sample the first potentiometer to determine the position of the first potentiometer by applying a voltage to the first potentiometer from the capacitor and measuring the voltage at a wiper of the first potentiometer.

7. The elevated work platform of claim 6, the controller being configured to sample the first potentiometer in less than five microseconds.

8. The elevated work platform of claim 4, the controller further configured to— identify a fault in the first position indicating element if a voltage reading on the capacitor after applying the voltage is below a predetermined lower threshold level or above a predetermined upper threshold level, and prevent sampling of the first position indicating element in which the fault was identified after the fault is detected.

9. The elevated work platform of claim 1, the electronic valve controller including a receiver for receiving a signal from the control interface, the receiver including a gain function and being configured to automatically adjust a gain level so that an output of the gain function remains constant as a strength of the received signal fluctuates.

10. The elevated work platform of claim 1, the electronic valve controller configured to confirm that a control signal received from the control interface includes valid signal values, and to disable the hydraulic valve if the control signal includes one or more invalid signal values.

11. The elevated work platform of claim 1, further comprising a fiber optic communications link or a wireless communications link for communicating control signals from the control interface to the electronic valve controller.

12. An elevated work platform comprising:

a boom presenting proximal and distal ends;

a platform located proximate the boom distal end;

a hydraulic control valve generally proximate the boom proximal end;

an electronic valve controller for controlling the hydraulic control valve;

a control interface communicatively coupled with the platform for receiving operating commands from a user and communicating the operating commands to the electronic valve controller, the control interface including— a multi-function single hand control with a set of position indicating elements for detecting actuation of the single hand control, wherein each of the position indicating elements in the set of position indicating elements includes a respective potentiometer, a master enable switch communicatively coupled with the set of position indicating elements, a set of individual enable elements, wherein each individual enable element in the set of individual enable elements is communicatively coupled with one of the position indicating elements in the set of position indicating elements, wherein the set of individual enable elements includes a first individual enable element and the set of position indicating elements includes a first position indicating element and a first potentiometer of said respective potentiometers, wherein the first enable element is communicatively coupled with the first position indicating element, wherein the first potentiometer is included in the first position indicating element, a capacitor configured to energize the first potentiometer, and a high impedance circuit configured to charge the capacitor, the high impedance circuit having an impedance of at least 500 kΩ; and a controller for controlling operation of the control interface, the controller configured to sample the first position indicating element only if the master enable switch is actuated and the first individual enable element is actuated, wherein the capacitor energizes the first potentiometer when the controller samples the first potentiometer.

13. The elevated work platform of claim 12, the controller being configured to sample the first potentiometer to determine the position of the first potentiometer by applying a voltage to the first potentiometer from the capacitor and measuring the voltage at a wiper of the first potentiometer.

14. The elevated work platform of claim 13, the controller being configured to sample the first potentiometer in less than five microseconds.

15. The elevated work platform of claim 12, the controller further configured to— identify a fault in the first position indicating element if a voltage reading on the capacitor after applying the voltage is below a predetermined lower threshold level or above a predetermined upper threshold level, and prevent sampling of the first position indicating element in which the fault was identified after the fault is detected.

16. The elevated work platform of claim 12, the electronic valve controller including a receiver for receiving a signal from the control interface, the receiver including a gain function and being configured to automatically adjust a gain level so that an output of the gain function remains constant as a strength of the received signal fluctuates.

17. The elevated work platform of claim 12, the electronic valve controller configured to confirm that a control signal received from the control interface includes valid signal values, and to disable the hydraulic valve if the control signal includes one or more invalid signal values.

18. The elevated work platform of claim 12, wherein said controller is configured to— operate in a normal operating mode, wherein the controller periodically reads the master enable switch and, if the master enable switch is actuated, samples the first position indicating element if the first individual enable is actuated, operate in a low power mode if the master enable switch is not actuated for a predetermined amount of time, wherein the controller reads the master enable switch less frequently than in the normal operating mode, and return to the normal operating mode when it samples the first position indicating element.

19. The elevated work platform of claim 12, further comprising a fiber optic communications link or a wireless communications link for communicating control signals from the control interface to the electronic valve controller.

20. An elevated work platform comprising:

a boom presenting proximal and distal ends;

a platform located proximate the boom distal end;

a hydraulic control valve generally proximate the boom proximal end;

an electronic valve controller for controlling the hydraulic control valve;

a control interface communicatively coupled with the platform for receiving operating commands from a user and communicating the operating commands to the electronic valve controller, the control interface including— a multi-function single hand control with a set of position indicating elements for detecting actuation of the single hand control, wherein each of the position indicating elements within the set of position indicating elements includes a respective potentiometer, a master enable switch communicatively coupled with the set of position indicating elements, a set of individual enable elements, wherein each individual enable element in the set of individual enable elements is communicatively coupled with one of the position indicating elements in the set of position indicating elements, wherein the set of individual enable elements includes a first individual enable element and the set of position indicating elements includes a first position indicating element and a first potentiometer of said respective potentiometers, wherein the first enable element is communicatively coupled with the first position indicating element, wherein the first potentiometer is included in the first position indicating element, a capacitor configured to energize the first, and a controller for controlling operation of the control interface, the controller configured to sample the first position indicating element only if the master enable switch is actuated and the first individual enable element is actuated, said controller being configured to— identify a fault in the first position indicating element if a voltage on the capacitor after applying the voltage is below a predetermined lower threshold level or above a predetermined upper threshold level, and prevent sampling of the first position indicating element after the fault is detected, wherein the capacitor energizes the first potentiometer when the controller samples the first potentiometer.

* * * * *